US005842696A

United States Patent [19]

Haan et al.

[11] Patent Number: 5,842,696

[45] Date of Patent: Dec. 1, 1998

[54] TURN-OVER AND SHINGLING APPARATUS

[75] Inventors: Henk Haan, Niagara Falls; Stephen Michalovic, Williamsville; John A. Sabatowski, Grand Island, all of N.Y.

[73] Assignee: Moore Business Forms, Inc., Grand Island, N.Y.

[21] Appl. No.: 685,834

[22] Filed: Jul. 25, 1996

[51] Int. Cl.[6] ..... B65H 5/00

[52] U.S. Cl. ..... 271/225; 198/404; 198/460.3; 271/266; 271/216; 271/186; 271/265.01

[58] Field of Search ..... 271/225, 266, 271/151, 216, 184, 186, 187, 265.01; 198/402, 403, 404, 460.3, 462.2

[56] References Cited

U.S. PATENT DOCUMENTS

| | | | |
|---|---|---|---|
| 3,880,420 | 4/1975 | Martin | 271/184 |
| 4,487,408 | 12/1984 | Fischer | 271/187 |
| 5,090,680 | 2/1992 | Yashiro . | |
| 5,094,441 | 3/1992 | Sebileau . | |
| 5,240,243 | 8/1993 | Gompertz et al. . | |
| 5,485,989 | 1/1996 | McCay et al. . | |
| 5,611,530 | 3/1997 | Maresse et al. | 271/187 |

FOREIGN PATENT DOCUMENTS

| | | | |
|---|---|---|---|
| 0258052 | 12/1985 | Japan | 271/186 |
| 0012513 | 1/1986 | Japan | 198/404 |
| 403166160 A | 7/1991 | Japan | 271/184 |
| 93 001115 A1 | 1/1993 | WIPO | 271/184 |

*Primary Examiner*—H. Grant Skaggs
*Attorney, Agent, or Firm*—Nixon & Vanderhye P.C.

[57] ABSTRACT

A sheet inverter is used in a method of handling documents, preferably to invert the documents, change them from an in-line configuration to a shingled configuration, and then move them in a direction substantially transverse to the original direction of conveyance of the documents. An inverter shaft is rotatable about a generally horizontal axis and has a plurality of sheet supporting elements, such as rods or bars (such as in an exaggerated generally S-shaped configuration) axially spaced from each other along the shaft, with each sheet supporting element comprising first, second and third portions defining first, second and third closed sides for receipt of a document, and an open fourth side by which the document may enter the elements. A support structure connects each of the sheet supporting elements (either together or individually) to the shaft for rotation with the shaft about its axis. The sheet supporting elements receive one or more documents at a first vertical level, which documents are sensed by a sensor. The supporting elements are then rotated with the shaft to deposit the documents (in association with stops) on a lower conveyor. The sheet supporting elements pass through openings between elements of the bottom conveyor and move back to the original position, which is sensed by another sensor, to await the next set of documents.

18 Claims, 5 Drawing Sheets

TURN-OVER AND SHINGLING APPARATUS

BACKGROUND AND SUMMARY OF THE INVENTION

There are many situations during document production, and book, magazine, or signature manufacturing processes, when it is necessary to invert one or more sheets. Also there are times when it is necessary to move sheets from an in-line (in seriatim) configuration to a shingled configuration, and when it is necessary to change the direction of movement of the documents (e.g. from one horizontal direction to a substantially transverse horizontal direction). For example in the production of booklets such as on a Kodak saddle stitch booklet line, sheet stacks that vary from one sheet to one-half inch thick in dimension must be inverted to have bar code indicia thereon face a reader in the line, and it is necessary to shingle the booklets for further handling.

According to the present invention a method and apparatus are provided for handling of sheets, such as documents including stacks of documents, in a simple and reliable manner to invert the documents. The method and apparatus according to the invention also can, substantially simultaneously with the inverting action, move documents from an in seriatim configuration to a shingled configuration, and may move the documents so that they are changed from movement in one horizontal direction to a substantially transverse horizontal direction. The apparatus according to the invention has a minimum number of components, which are relatively inexpensive, yet can effectively perform any one or more of these functions.

According to one aspect of the present invention a method of handling printed documents is provided. The method comprises the following steps: (a) Transporting a plurality of printed documents, in seriatim, in a first substantially flat configuration in a first direction. (b) Inverting the documents by rotating each document, one at a time, about a generally horizontal dimension substantially perpendicular to the first direction, so that each document moves from a first substantially flat configuration to a second substantially flat, inverted, configuration. (c) Shingling the documents as they are moved from the first configuration to the second configuration. And, (d) moving the shingled documents in a second direction substantially transverse to the first direction.

Step (a) is typically practiced using a first conveyor and step (d) a second conveyor, and step (c) is practiced by moving the second conveyor in a different manner (e.g. so that it operates intermittently rather than continuously, or so that it operates at a slower speed) than the first conveyor in order to introduce a time lag between them.

The invention also relates to an apparatus for handling documents. The apparatus comprises: A first conveyor for transporting a plurality of documents, in seriatim, in a first substantially flat configuration in a first direction. Means for inverting the documents by rotating each document, one at a time, about a generally horizontal dimension substantially perpendicular to the first direction, so that each document moves from a first substantially flat configuration to a second substantially flat, inverted, configuration. Means for shingling the documents as they are moved from the first configuration to the second configuration. And, a second conveyor for moving the shingled documents in a second direction substantially transverse to the first direction.

The shingling means may comprise means for controlling the relative operations of the first and second conveyors so that the second conveyor operates with a time delay compared to the first conveyor. The inverting means may comprise a plurality of exaggerated generally S-shaped wires connected to a shaft which is rotatable about an axis substantially parallel to, and above, the second conveyor.

The inverter structure per se according to the invention has few and inexpensive components. For example, the sheet inverter according to the invention may comprise the following components: An inverter shaft rotatable about a generally horizontal axis. A plurality of sheet supporting elements axially spaced from each other along the shaft. Each sheet supporting element comprising first, second and third portions defining first, second and third closed sides, and an open fourth side opposite the second portion, an interior volume being defined by the first through third elements. And, a support structure connecting each of the sheet supporting elements to the shaft for rotation with the shaft about the axis.

The first, second and third portions of the sheet supporting element preferably comprise rods, plates, or bars, such as metal wires or sheet metal (e.g. steel) with slots. For example the first, second and third portions of each of the sheet supporting elements may comprise an integral metal wire also integral with a portion of the support structure comprising a wire making an acute angle with respect to the third portion. The support structure wire portion is releasably connected directly to the shaft, either individually, or through a common connection with the other sheet supporting elements. Alternatively, the third portion of each element may be substantially directly connected to the shaft by the support structure. Reinforcing structures may extend between the sheet supporting elements as long as they do not interfere with rotation of the shaft.

The sheet inverter preferably further comprises a first sensor (such as a photoelectric sensor) for sensing the presence of a sheet within the volume defined by the first, second and third portions of a sheet supporting element. A second sensor (which may also be a photoelectric sensor) also is preferably provided for sensing the orientation of the shaft in a position in which the sheet supporting elements desirably receive at least one sheet therein. The second sensor may be mounted on the shaft or on a stationary component which senses the position of the shaft.

Typically the sheet inverter is in combination with a first conveyor for conveying sheets in a first generally horizontal direction into the operative association with the sheet supporting elements; and a second conveyor, mounted at a lower vertical level than the first conveyor, for conveying sheets deposited thereon by the sheet supporting elements in a second generally horizontal direction substantially transverse to the first direction. A plurality of adjustably positionable stops are mounted adjacent the second conveyor and facilitates stripping of a sheet from the sheet supporting elements to properly position the sheet on the second conveyor. The second conveyor may comprise a plurality of rollers spaced from each other in the second direction, with spaces disposed therebetween. The sheet supporting elements are aligned with the spaces between the rollers and are dimensioned so that during rotation with the shaft the elements move into the spaces and their rotation is not hindered by the second conveyor.

An electric motor, or like power source, having an output shaft is provided for powering the inverter shaft and is operatively connected to the inverter shaft. Preferably particular pulleys and belts, gears, or chains and sprockets, are provided for the connection so that for each revolution of the motor output shaft there is less than half of one revolution of the inverter shaft (e.g. a 1:4 ratio). The first conveyor conveys the sheets in a first generally horizontal direction and is at a first vertical level while the second conveyor is mounted at a lower vertical level, and although it may convey sheets deposited thereon in the first direction it typically conveys them in a second direction substantially perpendicular to the first direction. While in the preferred method of operating an apparatus the second conveyor is controlled with respect to the first conveyor so that the sheets are shingled, they may be maintained in an in seriatim configuration. Also if the first conveyor is properly controlled and the sheets have the proper orientation they may be in shingled configuration when delivered to the sheet supporting elements.

It is the primary object of the present invention to provide for the simple yet effective inversion and other handling of one or more sheets during various production and manufacturing processes. This and other objects of the invention will become clear from an inspection of the detailed description of the invention and from the appended claims.

DETAILED DESCRIPTION OF THE DRAWINGS

Figure 1:
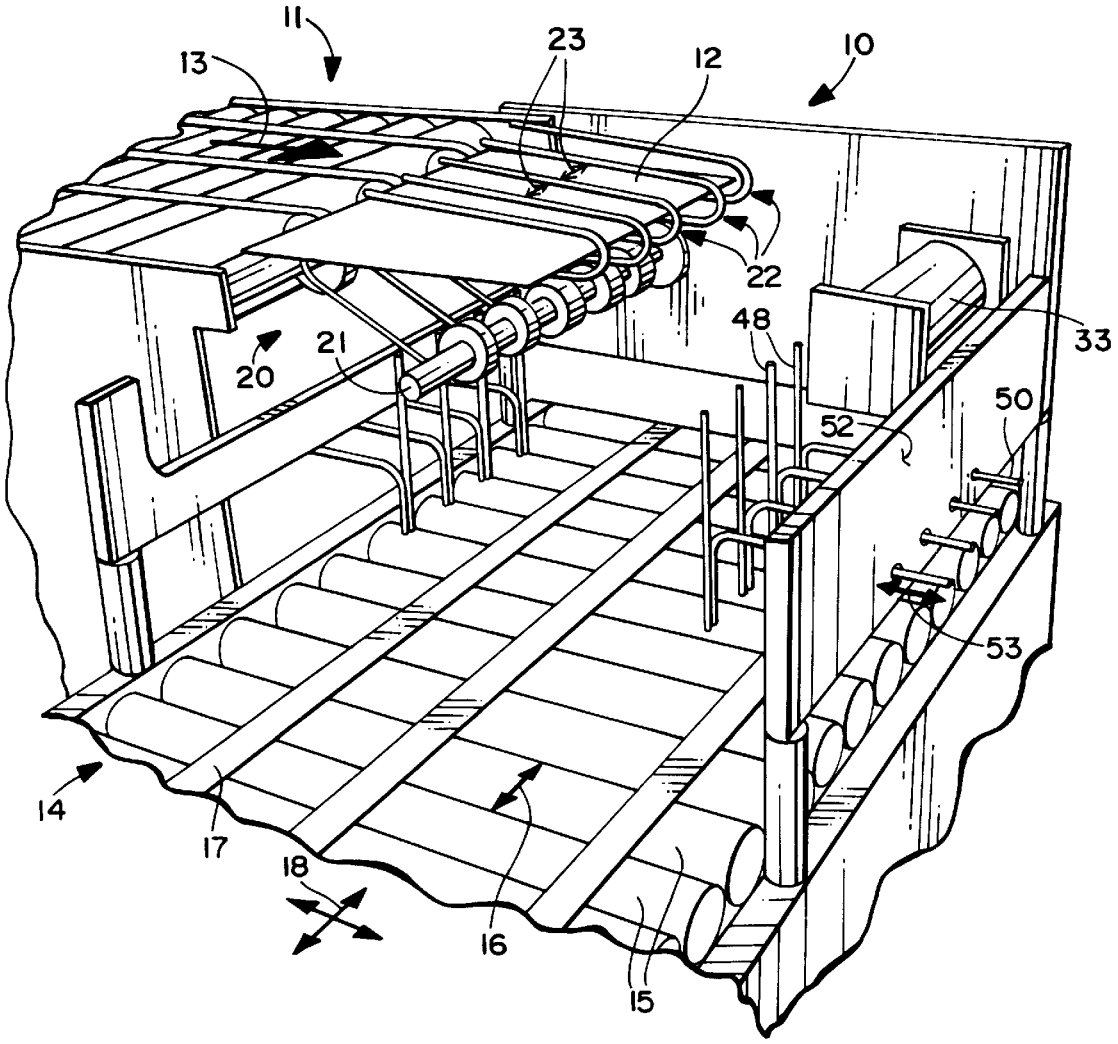
FIG. 1 is a top perspective view of an exemplary apparatus for handling documents according to the present invention.

FIGS. 1 through 4 illustrate exemplary apparatus for handling sheets, such as documents, including printed documents, according to the present invention, and useful in a method of handling the documents. Major components of the apparatus of FIGS. 1 through 4 include the first conveyor 11 for transporting a plurality of documents (either in the form of individual sheets or stacks up to one-half inch thick), a typical stack of documents being illustrated at 12 in FIGS. 1, 3, 4 and 5. The conveyor 11 may be any conventional type, such as a roller, belt, combination roller and belt, or any other suitable conventional configuration of conveyor, and typically conveys the documents 12 in a first substantially flat configuration in a first direction 13 (typically a generally horizontal direction).

The apparatus 10 further comprises a second conveyor, shown schematically at 14, which may also comprise almost any conventional configuration, just like the conveyor 11, but preferably comprises a plurality of rollers 15 which have spaces 16 therebetween and which may or may not include conveyor tapes or belts, such as the conveyor tape 17, extending over the rollers 15. While the conveyor 14 may be configured so that it moves documents deposited thereon in the direction 13, or any other direction, preferably it conveys the documents in a second direction 18. The second direction 18 may be backward, forward, or almost any other direction with respect to the first direction 13. Preferably the second direction 18 is substantially transverse to the first direction 13.

Disposed between the first and second conveyors 11, 14 is a sheet inverter according to the present invention, shown generally by reference numeral 20 in the drawings. The sheet inverter 20 includes an inverter shaft 21 which is rotatable about a generally horizontal axis. For example the axis of rotation of the inverter shaft 21 may be substantially parallel to the direction 18 and substantially transverse to the direction 13.

The inverter 20 further comprises a plurality of sheet supporting elements each shown generally by reference numeral 22. While almost any number of sheet supporting elements 22 are provided preferably there are at least three, and typically about four or five. The sheet supporting elements are spaced from each other—as indicated by the spacing 23 in FIG. 1—axially along the shaft 21. Each sheet supporting element 22 may have—as best seen in FIG. 2—an exaggerated generally S-shaped configuration, although each may be configured merely as a simple loop. That is each element 22 includes—as seen in FIG. 2—a first portion 24, a second portion 25, and a third portion 26 defining first, second and third closed sides, and an open fourth side 27 opposite the second portion 25.

While the elements 22 can have a wide variety of constructions, such as made of plates, webs, blocks, baskets, meshes, or the like, preferably elements 22 are made of rods or bars, particularly of metal or plastic. In the preferred embodiment they are metal wires which are either polygonal or preferably circular in cross-section, all of the portions 24–26 being an integral piece of wire. The second portion 25 is shown bent with a convex curvature, but it could be squared or concave—that is curved into the interior volume 28 defined by the portions 24–26—rather than convex. Reinforcing structures (e.g. braces, wires, bars, etc.—not shown) may extend between elements 22 as long as they do not interfere with rotation of shaft 21.

The sheet inverter 20 also comprises a support structure for connecting each of the sheet supporting elements 22 to the shaft 21. In the embodiment illustrated in FIG. 2, the support structure includes an integral wire portion 29, integral with the third portion 26, for example connected by the reverse curvature bend 30 thereof, and any suitable fastening mechanism, shown generally by reference numeral 31, for fastening the wire portion 29 to the shaft 21. For example the fastening structure 31 may comprise a bracket or collar which is connected to the shaft 21 by screw threaded or like removable fasteners. However, the support structure can have a wide variety of other configurations. For example the support structure may comprise a permanent connection (such as a weld or adhesive) of the wire 29 to the shaft 21, or a permanent or releasable connection of the portion 26 directly to the shaft 21 or a super structure on shaft. The exact configuration of the supporting structure 29, 31, etc. will be determined by the desired spacing of the interior volume 28 from the shaft 31 in the vertical dimension, the length of the interior volume 28, the particular positioning of the conveyors 11, 14, and a wide variety of other factors.

The sheet inverter 20 also includes a powering device for powering the shaft 21 to rotate it, preferably in the clockwise direction as illustrated by arrow 32 in FIG. 2. Preferably the powering mechanism includes an electric motor 33 having an output shaft 34 which is substantially parallel to and horizontally and/or vertically spaced from the inverter shaft 21. In the exemplary embodiment most clearly seen in FIG. 2 the shafts 21, 34 are at the same vertical position. The shaft 34 has a pulley 35 connected thereto which is connected by a belt—shown in dotted line at 36 in FIG. 2—to another pulley—illustrated in dotted line at 37 in FIG. 2—connected to the shaft 21 for driving the shaft 21. Typically the pulleys 35, 37 have a ratio such that for each rotation of the motor output shaft 34 the inverter shaft rotates less than one-half a revolution. Preferably the ratio between the pulleys 35, 37 is about 1:4.

Figure 6:
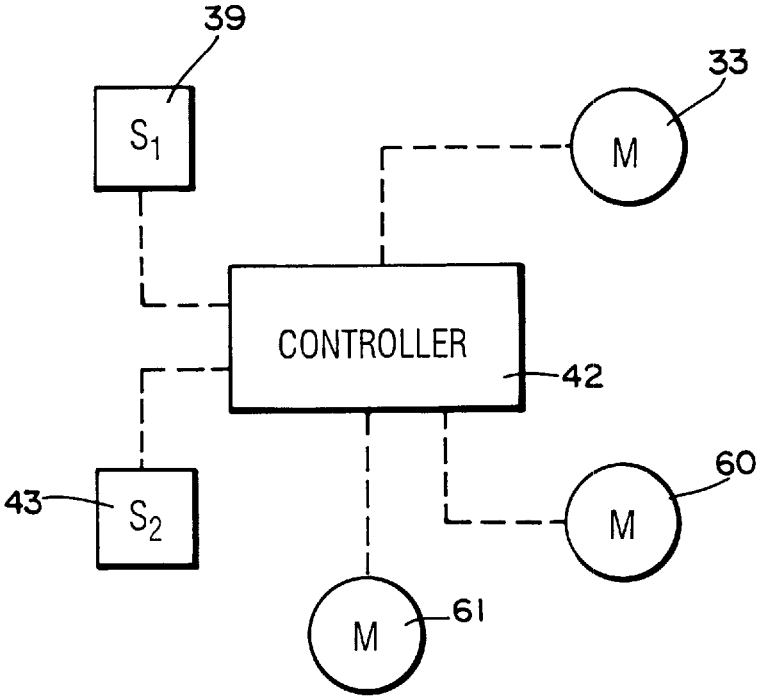
FIG. 6 is a control schematic illustrating the sensors, motors, and controller that may be utilized with the apparatus of FIGS. 1 through 4.

The sheet inverter 20 also preferably comprises a first sensor, such as the sensor 39 illustrated in FIGS. 2 and 6, that senses the presence of one or more sheets in the volume 28. While the sensor 39 may be mounted at a wide variety of different positions, one suitable position is illustrated in FIG. 2, on an arm 40 extending outwardly from the apparatus 10 in the direction 13 and substantially parallel to the portion 26 of the sheet supporting element 22. The sensor 39 may be any conventional type of proximity sensor including pneumatic, magnetic, or like sensors. Preferably it comprises an optical sensor, such as a photoelectric sensor, and is of conventional construction. Preferably the arm 40 is positioned on the apparatus 10 shaft 21 so that it is next to element 22 so that there is a clear optical path to documents 12 within the volume 28, and so that element 22 can rotate.

The sensor 39 is connected—e.g. through a conventional controller 42 (see FIG. 6) which controls the motor 33 to—after a time delay—effect rotation of the inverter shaft 21 in the direction 32 once a sheet or sheets 12 have been sensed in the volume 28.

The inverter 20 also preferably comprises a second sensor, shown schematically 43 in FIG. 6. The second sensor 43 may also be of any conventional type, but preferably is an optical sensor, and is mounted near the shaft 21 which has an arm to trigger the sensor 43, or in a stationary position near the conveyor 11, to sense when the inverter shaft is in the position illustrated in FIGS. 1 and 2, where the open portion 27 of the interior volume 28 is aligned with the conveyor 11 to receive sheets 12 from the conveyor 11 therein. When the sensor 39 senses sheets 12 in volume 28 it controls, through the controller 42, the motor 33 to start rotation of the shaft 21 in the direction 32 illustrated in FIG. 2.

Figure 2:
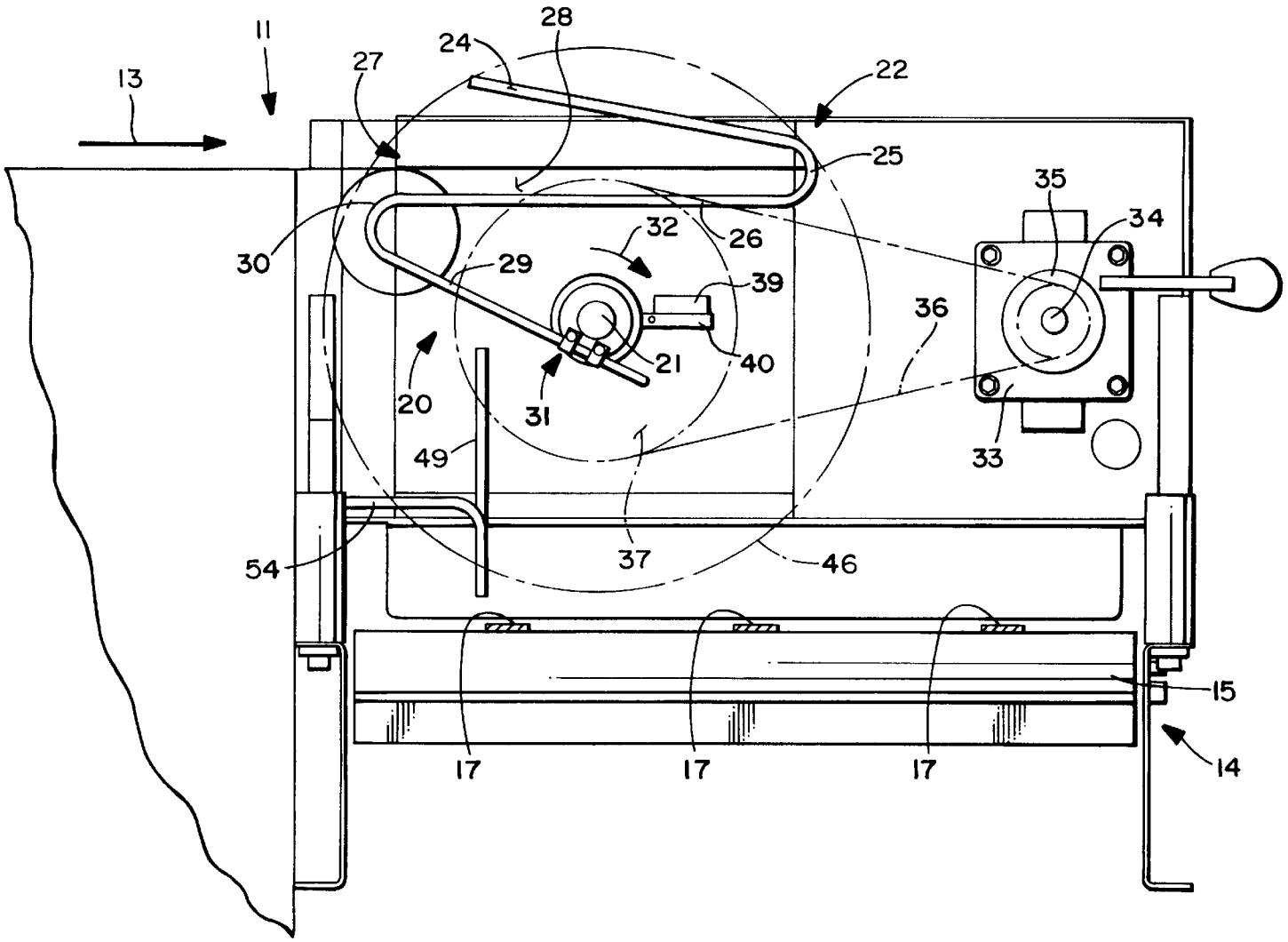
FIG. 2 is a detail side view of the apparatus of FIG. 1 clearly illustrating the shapes of the sheet supporting elements associated therewith and the mounting thereof on a shaft and along with a sensor.
Figure 3:
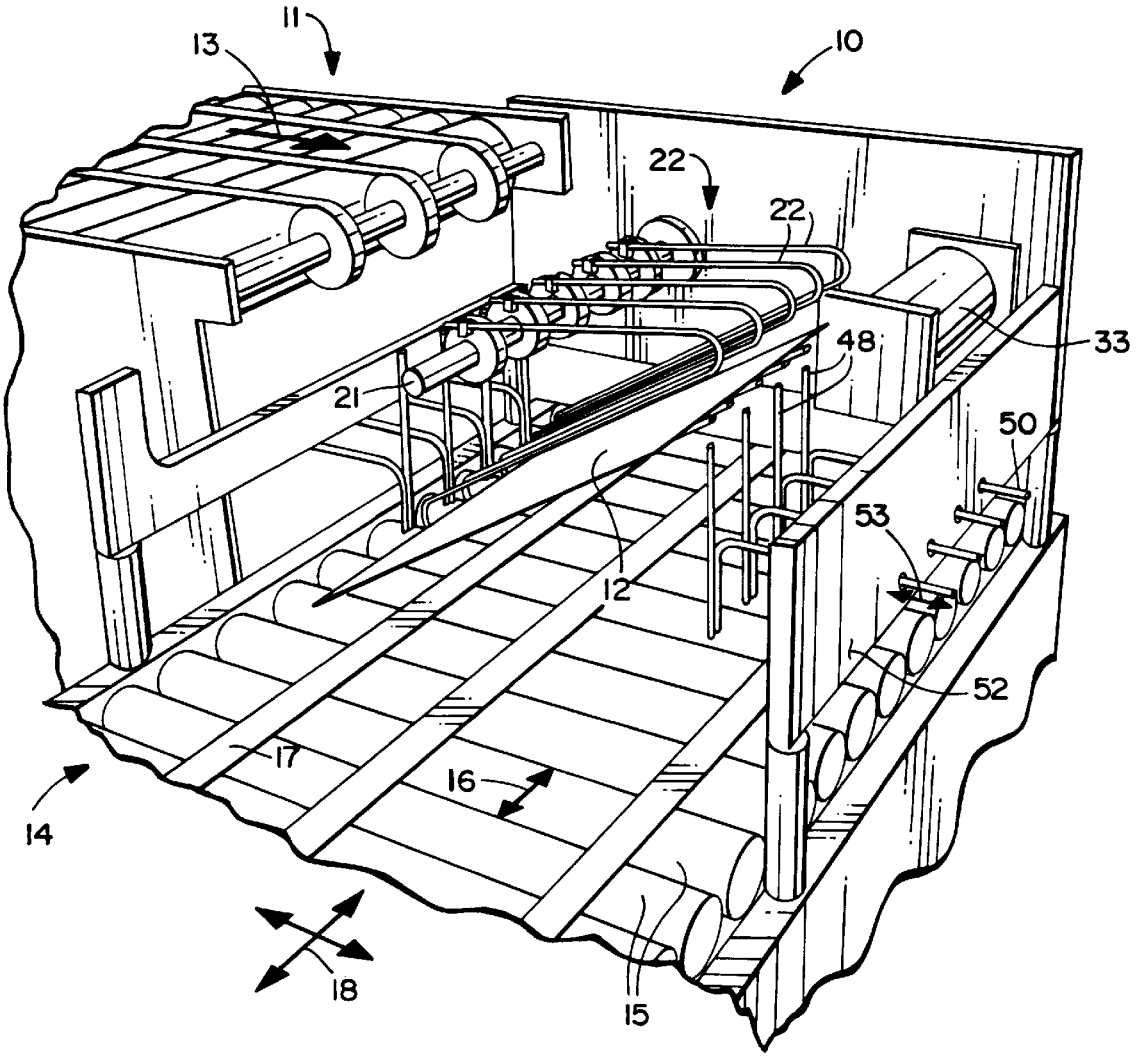
FIG. 3 is a view like that of FIG. 1 only showing the position of the components after the shaft has been rotated through approximately 120°–160°.
Figure 4:
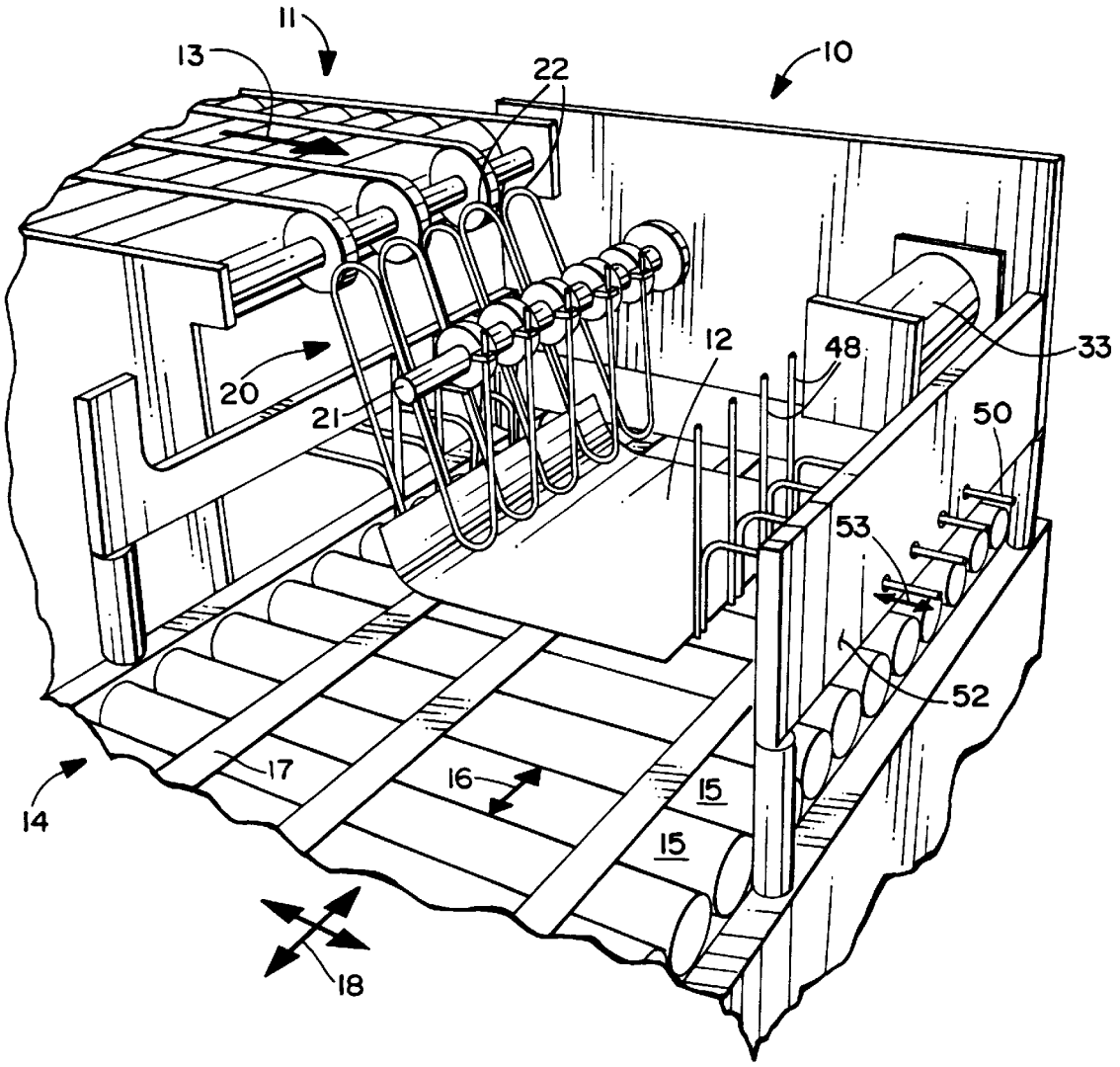
FIG. 4 is a view like that of FIGS. 1 and 3 only showing the components after the shaft has rotated through an arc of about 210°–250°.

When the shaft 21 is rotated in the direction 32, it rotates from the position illustrated in FIGS. 1 and 2 through the positions illustrated in FIGS. 3 and 4. As it rotates in this manner the first portion 24 of each of the supporting elements 22 moves through an arc—as indicated by dotted line 46—that typically goes over the top of the conveyor 14. However even if the arc 46 is beneath the top of conveyor 14, because the elements 22 are positioned so that they are aligned with spaces 16 between the rollers 15, the second conveyor 14 does not interfere with the rotation of the elements 22. However this motion does positively lay the document or stack of documents 12 on the top surface of the second conveyor 14.

Controlled movement of the documents 12 out of the volume 28 is facilitated by the stops 48, 49 provided on opposite sides of the second conveyor 14. The positions of the stops 48, 49 are readily adjusted depending upon the width of the documents 12 and a variety of other factors. For example the stops 48 are connected to clamps 50 on the underside of the support wall 52 for the apparatus 10 so that the rods 50 may be moved in the dimension 53 (parallel to the direction 13) to position the stops 48 any place desired, the bottoms of the stops 48 being at or slightly above the top of the conveyor 14. Rods 54 (see FIG. 2) connected to the stops 49 opposite the stops 48, may be similarly adjusted. The stops 48, 49 are spaced from elements 22 in direction 18 so that elements 22 never engage a stop 48, 49.

Where conveyor tapes 17 are provided—if arc 46 goes below them—they are positioned with respect to the rollers 15 so that they do not interfere with the rotation of the element 22 along the arc 46, or if engaged by the elements 22 the tapes 17 have sufficient flexibility to be moved out of the way without significantly adversely impacting the rotation of the elements 22.

Figure 5:
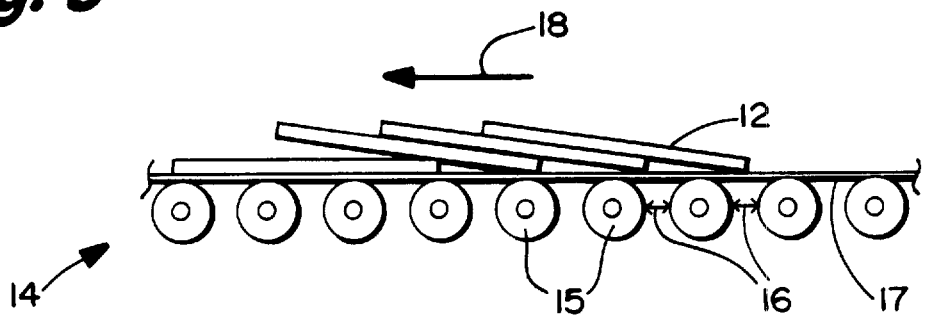
FIG. 5 is a side schematic view illustrating a shingled configuration of the documents on the second, lower conveyor in the apparatus of FIGS. 1 through 4.

The conveyor 14 is controlled by a motor 60 (see FIG. 6) while the conveyor 11 is also controlled by a motor 60, or by a separate motor 61 (see FIG. 6). The motor 60 (or the motors 60, 61) are controlled through the controller 42 to get any desired relative movement between the conveyors 11, 14. For example the documents 12 may be shingled on the conveyor 11 and may be deshingled by proper control of the conveyor 14. However in the preferred embodiment in which the apparatus 10 is utilized, the conveyors 11, 14 are controlled so that the documents 12 are in seriatim on the conveyor 11 but are moved to a shingled configuration—as illustrated in FIG. 5—on the conveyor 14. This is done by either intermittently operating the conveyor 14, or intermittently operating both conveyors 11, 14 but operating the conveyor 14 so that it is slower than the conveyor 11—so that there is a time lag between the conveyors 11, 14. The shingling and inverting action is particularly desirable, for example, in a Kodak saddle stitch booklet line where when the documents 12 are inverted a bar code will be on the top of the documents 12 as seen in FIG. 5 to be read by a reader. While a wide variety of different degrees of overlap of the documents 12 in the shingled configuration illustrated in FIG. 5 may be provided, the overlapping cannot be so great that the document already laying on the conveyor 14 will interfere with the rotation of the elements 22 in the arc 46.

Under some circumstances where a particular positive feed of the documents by the conveyor 14 is necessary, and/or where a high degree of shingling is necessary, and/or where the documents will have a particular lengths or widths, it may be necessary to mount the inverter shaft 21 so that it is spaced from the top of the conveyor 14 so that the rotational arc 46 of the elements 22 never passes below the top of the conveyor 14.

In a particular desired method of utilization of the apparatus 10 shown in the drawings, for example in the handling of printed documents, the documents 12 are first transported, in seriatim, in a first substantially flat configuration in the first direction 13, as seen in FIG. 1. The documents 12 are moved by the conveyor 11 through the open portions 27 of the sheet supporting elements 22 into the interior volume 28 thereof, and the presence of the documents 12 is sensed by the sensor 39. After an appropriate time delay, such as provided by the controller 42, the motor 33 is then operated to drive the shaft 34, which through the pulleys 35, 37 and the belt 36, drives the inverter shaft 21 in the direction 32. Shaft 21 rotates relatively slowly so that the open portion 27 of the elements 22 moves through the position illustrated in FIG. 3 to the position illustrated in FIG. 4 where the documents 12 are moved into engagement with the stops 49, and ultimately the stops 48, and so that the documents 12 will be gently laid on the upper surface of the conveyor 14.

The motor 60, or the motors 60 and 61, is/are controlled so that when the documents 12 are placed down they form a shingled configuration of documents as illustrated in FIG. 5, overlapping the previous documents 12 disposed on the conveyor 14. The shaft 21 continues its continuous substantially uniform speed rotation in the direction of arrow 32 until it returns to the position illustrated in FIGS. 1 and 2, at which point the sensor 43 senses that location and stops the motor 33, so that the elements 22 are ready to receive another set of documents 12 from the conveyor 11.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of handling printed documents comprising the steps of:

(a) using a first conveyor transporting a plurality of printed documents, in seriatim, in a first substantially flat configuration in a first direction;

(b) inverting the documents by rotating each document, one at a time, about a generally horizontal dimension substantially perpendicular to the first direction, so that each document moves from a first substantially flat configuration to a second substantially flat, inverted, configuration;

(c) shingling the documents as they are moved from the first configuration to the second configuration; and (d) using a second conveyor, moving the shingled documents in a second direction; and wherein step (c) is practiced by moving the second conveyor in a different manner than the first conveyor to introduce a time lag therebetween, and by controlling the second conveyor so that it operates at a slower speed than the first conveyor, and wherein the second direction is substantially transverse to the first direction.

2. A method as recited in claim 1 wherein step (c) is practiced by controlling the second conveyor so that it operates intermittently.

3. A sheet inverter comprising:

an inverter shaft rotatable about a generally horizontal axis;

a plurality of sheet supporting elements axially spaced from each other along said shaft;

each sheet supporting element comprising first, second and third portions comprise rods, plates, or bars defining first, second and third closed sides, and an open fourth side opposite said second portion, an interior volume defined by said first, second, and third portions; and a support structure connecting each of said sheet supporting elements to said shaft for rotation with said shaft about said axis; and wherein said first, second and third portions of each of said sheet supporting elements comprises an integral wire, also integral with a portion of said support structure comprising a wire making an acute angle with respect to said third portion, said support structure wire portion releasably connected directly to said shaft.

4. A sheet inverter as recited in claim 3 further comprising a first sensor for sensing the presence of a sheet within said interior volume.

5. A sheet inverter as recited in claim 4 further comprising a second sensor for sensing the orientation of said shaft in a position in which said sheet supporting elements desirably receive at least one sheet therein.

6. A sheet inverter as recited in claim 3 further comprising an electric motor having an output shaft for powering said inverter shaft and operatively connected to said inverter shaft so that each revolution of said motor output shaft results in less than half of one revolution of said inverter shaft.

7. A sheet inverter assembly comprising:

an inverter shaft rotatable about a generally horizontal axis;

a plurality of sheet supporting elements axially spaced from each other along said shaft;

each sheet supporting element comprising first, second and third portions defining first, second and third closed sides, and an open fourth side opposite said second portion, an interior volume defined by said first, second, and third portions;

a support structure connecting each of said sheet supporting elements to said shaft for rotation with said shaft about said axis;

a first conveyor for conveying sheets in a first generally horizontal direction into the operative association with said sheet supporting elements; and a second conveyor, mounted at a lower vertical level than said first conveyor, for conveying sheets deposited thereon by said sheet supporting elements in a second generally horizontal direction; and a plurality of adjustably positionable stops mounted adjacent said second conveyor facilitating stripping of a sheet from said sheet supporting elements to properly position the sheet on said second conveyor.

8. A sheet inverter as recited in claim 7 wherein said first, second and third portions of said sheet supporting element comprise rods, plates, or bars.

9. A sheet inverter as recited in claim 8 wherein said first, second and third portions of each of said sheet supporting elements comprises an integral wire, also integral with a portion of said support structure comprising a wire making an acute angle with respect to said third portion, said support structure wire portion releasably connected directly to said shaft.

10. A sheet inverter as recited in claim 8 in combination with a first conveyor for conveying sheets in a first generally horizontal direction into the operative association with said sheet supporting elements; and a second conveyor, mounted at a lower vertical level than said first conveyor, for conveying sheets deposited thereon by said sheet supporting elements in a generally horizontal direction.

11. A sheet inverter as recited in claim 10 further comprising a plurality of adjustably positionable stops mounted adjacent said second conveyor facilitating stripping of a sheet from said sheet supporting elements interior volume to properly position the sheet on said second conveyor.

12. A sheet inverter as recited in claim 7 wherein said second conveyor comprises a top surface, and wherein said sheet supporting elements are positioned so that when rotated they always remain above said top surface.

13. A sheet inverter assembly comprising:

an inverter shaft rotatable about a generally horizontal axis;

a plurality of sheet supporting elements axially spaced from each other along said shaft;

each sheet supporting element comprising first, second and third portions defining first, second and third closed sides, and an open fourth side opposite said second portion, an interior volume defined by said first, second, and third portions;

a support structure connecting each of said sheet supporting elements to said shaft for rotation with said shaft about said axis; a first conveyor for conveying sheets in a first generally horizontal direction into the operative association with said supporting elements; a second conveyor, mounted at a lower vertical level than said first conveyor, for conveying sheets deposited thereon by said sheet supporting elements in a second generally horizontal direction; and wherein said second conveyor comprises plurality of rollers spaced from each other in said second direction, having spaces disposed therebetween; and wherein said sheet supporting elements are aligned with, and dimensioned with respect to, said spaces between said rollers so that during rotation with said shaft said elements move into said spaces.

14. A sheet inverter assembly comprising:

an inverter shaft rotatable about a generally horizontal axis;

a plurality of sheet supporting elements axially spaced from each other along said shaft;

each sheet supporting element comprising first, second and third portions comprising rods, plates, or bars, and defining first, second and third closed sides, and an open fourth side opposite said second portion, an interior volume defined by said first, second, and third portions;

a support structure connecting each of said sheet supporting elements to said shaft for rotation with said shaft about said axis;

a first conveyor for conveying sheets in a first generally horizontal direction into the operative association with said sheet supporting elements; and a second conveyor, mounted at a lower vertical level than said first conveyor, for conveying sheets deposited thereon by said sheet supporting elements in a generally horizontal direction; and a first sensor for sensing the presence of a sheet within said interior volume.

15. A sheet inverter as recited in claim 14 further comprising a second sensor for sensing the orientation of said shaft in a position in which said sheet supporting elements desirably receive at least one sheet therein.

16. A sheet inverter as recited in claim 15 further comprising an electric motor having an output shaft for powering said inverter shaft and operatively connected to said inverter shaft so that each revolution of said motor output shaft results in less than half of one revolution of said inverter shaft.

17. Apparatus for handling documents comprising:

a first conveyor for transporting a plurality of documents, in seriatim, in a first substantially flat configuration in a first direction;

means for inverting the documents by rotating each document, one at a time, about a generally horizontal dimension substantially perpendicular to the first direction, so that each document moves from a first substantially flat configuration to a second substantially flat, inverted, configuration;

means for shingling the documents as they are moved from the first configuration to the second configuration; and a second conveyor for moving the shingled documents in a second direction; and wherein said shingling means comprises means for controlling the relative operations of said first and second conveyors so that said second conveyor operates with a time delay compared to said first conveyor, and wherein the second direction is substantially transverse to the first direction.

18. Apparatus for handling documents comprising:

a first conveyor for transporting a plurality of documents, in seriatim, in a first substantially flat configuration in a first direction;

means for inverting the documents by rotating each document, one at a time, about a generally horizontal dimension substantially perpendicular to the first direction, so that each document moves from a first substantially flat configuration to a second substantially flat, inverted, configuration;

means for shingling the documents as they are moved from the first configuration to the second configuration;

a second conveyor for moving the shingled documents in a second direction; and wherein said inverting means comprises a plurality of exaggerated generally S-shaped wires connected to a shaft which is rotatable about an axis substantially parallel to, and above, said second conveyor.

* * * * *